US005479734A

United States Patent [19]

Rouget et al.

[11] Patent Number: 5,479,734

[45] Date of Patent: Jan. 2, 1996

[54] DEVICE FOR INDIVIDUALIZING VERTICALLY STORED DOCUMENTS, FOR THE PURPOSES OF LOCATING AND IDENTIFYING THEM

[76] Inventors: Pierre Rouget; Gabrielle Rouget, both of 6, rue Martin de Brignaudy, 13007 - Marseille, France

[21] Appl. No.: 167,977

[22] PCT Filed: Jul. 3, 1992

[86] PCT No.: PCT/FR92/00637

§ 371 Date: Dec. 23, 1993

§ 102(e) Date: Dec. 23, 1993

[87] PCT Pub. No.: WO93/01061

PCT Pub. Date: Jan. 21, 1993

[30] Foreign Application Priority Data

Jul. 5, 1991 [FR] France ..... 91 08776

[51] Int. Cl.[6] ..... G09F 1/10

[52] U.S. Cl. ..... 40/373; 40/383; 206/425

[58] Field of Search ..... 40/373, 379, 383, 40/641; 211/50; 206/425, 560, 564, 565

[56] References Cited

U.S. PATENT DOCUMENTS

| | | | |
|---|---|---|---|
| 1,073,248 | 9/1913 | Kouba | 40/383 |
| 1,332,954 | 3/1920 | Ringler | 40/383 |
| 3,269,391 | 8/1966 | Wagner | 40/641 X |
| 3,785,520 | 1/1974 | Spees . | |
| 3,938,268 | 2/1976 | Gilhula | 40/641 |
| 4,127,690 | 11/1978 | Schleifenbaum et al. | 40/641 X |

FOREIGN PATENT DOCUMENTS

| | | | |
|---|---|---|---|
| 1186006 | 8/1959 | France . | |
| 1350845 | 12/1964 | France . | |
| 689088 | 3/1940 | Germany . | |
| 2730261 | 1/1979 | Germany | 40/373 |
| 238176 | 1/1964 | Netherlands . | |

*Primary Examiner*—Kenneth J. Dorner
*Assistant Examiner*—Joanne Silbermann
*Attorney, Agent, or Firm*—Dvorak and Traub

[57] ABSTRACT

A system for filing documents in a filing cabinet with a suspension rod. A suspension strip is fixed to a top edge of each document, and includes an orifice for receiving the suspension rod, and notches with an edge interposed therebetween. The notches and edges are identical from one suspension strip to one another. A scale is positioned behind the suspension strips of the documents, and displays identification information which is aligned with grooves formed by alignment of the notches of adjacent suspension strips. A tab fixed to a top portion of the suspension strip constitutes a guide mark for the document corresponding to which the suspension strip is fixed, wherein the tabs of different suspension strips are of different colors, and each color is associated with identification information which is displayed on the top portion of the scale for identifying documents.

20 Claims, 8 Drawing Sheets

FIG.6
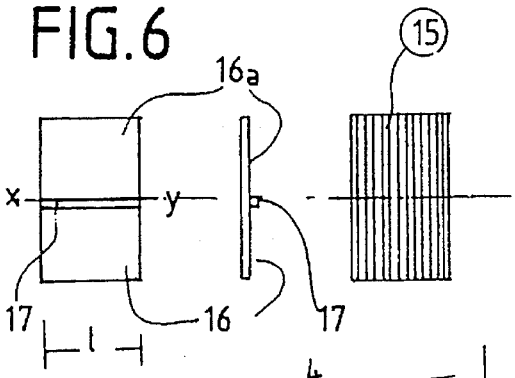
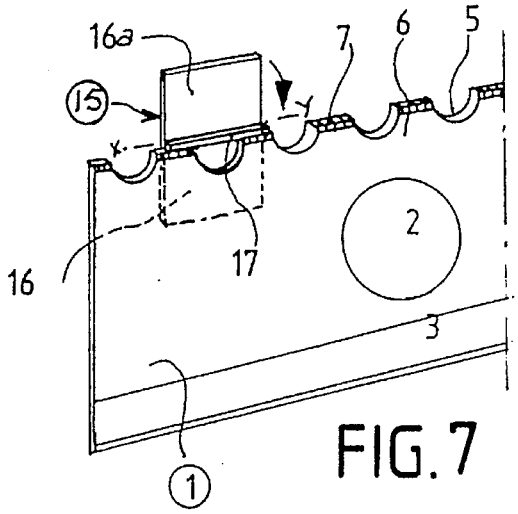
FIG.7
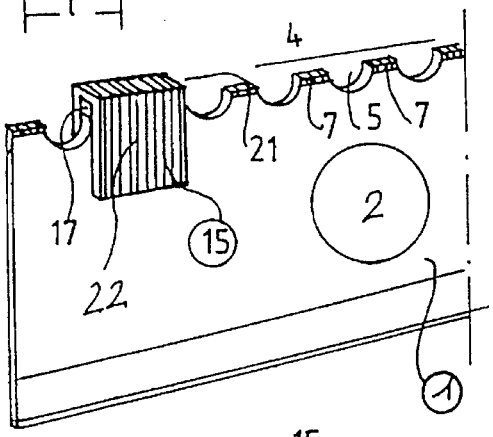
FIG.8
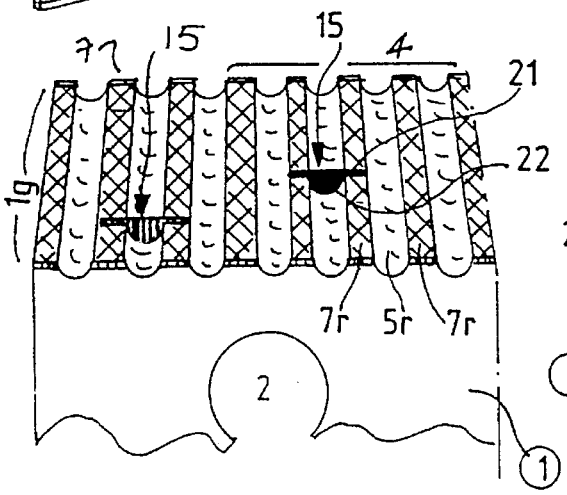
FIG.9
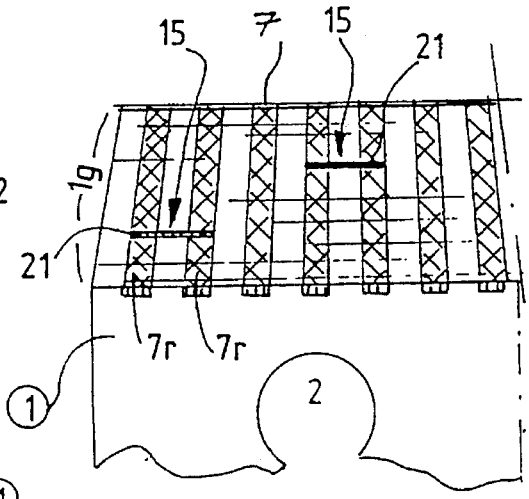
FIG.10
FIG.11
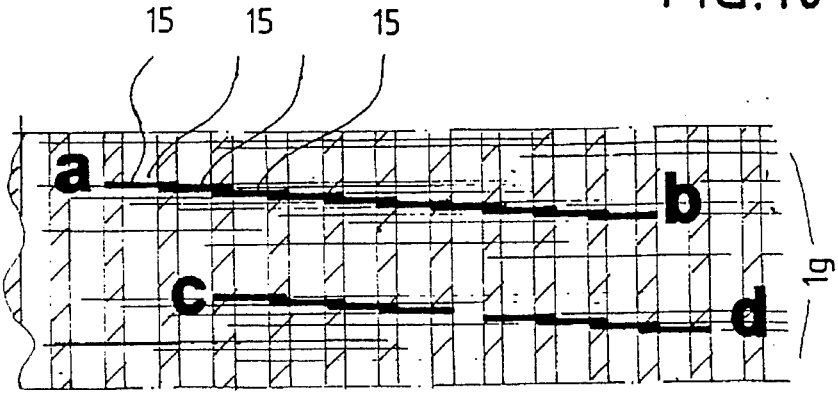

23N
24
N° 1.314
15 (rouge)
15 (rouge)
1.300
30
5r
5
2
14
1

23N
N° 1.314
n°1.311
36
37
1.300
30
2
14

DEVICE FOR INDIVIDUALIZING VERTICALLY STORED DOCUMENTS, FOR THE PURPOSES OF LOCATING AND IDENTIFYING THEM

DESCRIPTION

The present invention relates to a device and to a method for enabling large documents to be stored vertically without being ordered, while conferring individuality to each document, making it subsequently possible, without manual intervention, to locate and identify the document, or in the event of absence or error, enabling that situation to be observed visually.

The technical field of the invention is that of equipment for filing large documents vertically, whether they be made of paper, cloth, film, or light alloy, which documents may be made by drawing, writing, photography, etching, collage, or cutting out, the above lists not being limiting.

The advantage of storing documents vertically, particularly documents that are of large size, is to group them together in a volume that is compact and that occupies minimum floor space.

Documents of large size are generally suspended from rods that are parallel, substantially straight, and horizontal, and that are fixed in filing cabinets that may be referred to as filing cupboards or chests having vertical dividers, or else that are merely fixed to a wall or to any other support.

The theoretical capacity of a filing cabinet for large documents is generally 800, 1,000 or 1,500 documents.

The major drawback encountered by a user of the vertical method of filing documents is that it is difficult quickly to find a particular document that is desired without having to finger and leaf through the others, and this becomes particularly lengthy and fiddly when the size of the documents is 1 $m^2$, 2 $m^2$, or more.

The same applies when it is necessary to find the proper location for a document that is to be put back amongst the others.

To reduce these difficulties, the documents must be split up into small groups that are separated by guides made of card, and indexes must be placed on the top edges of the documents, which cards and indexes are often thicker than the documents themselves, thereby wasting space and going against the looked-for purpose of a vertical filing system.

In addition, the indexes often impede the passage of the documents through copying machines.

Identification systems exist that use numbers on labels that are stuck on or that are notched, or that use color coding, however those systems solve identification problems in part only and they enable documents to be located only by groups of ten, they are fiddly to implement, and in practice they are little used.

The user encounters other drawbacks, for example the need to return each document to the same place in its numerical order, the absence of any quick way of checking whether documents are missing, and enormous amounts of time are lost in the event that one of the documents has been put in the wrong place.

The present invention seeks to remedy the above drawbacks.

The object to be achieved is a device and a method for individualizing each of the documents forming parts of a group, that are stored vertically one in front of another by being suspended from rods that are substantially straight and horizontal, and that makes it possible at all times to check whether said documents are present or absent, and to make it possible to identify each of them visually without manual intervention.

This object is achieved (FIGS. 15 and 16, sheet 5) by the device and the method of the invention which consists in writing or printing the numerical or alphabetical elements that particularize each document on a horizontal scale that is positioned above and behind the vertically stored documents that are juxtaposed one in front of another, the relationship between said elements and a tab fixed on the top edge of each document being indicated by grooves and stripes that result from contiguous juxtaposition of crenelations and markings on the top edges of the documents.

The result of the invention constitutes vertical storage of large documents that does not necessarily require the documents to be placed in a determined order relative to one another, each document remaining locatable and identifiable visually without requiring manual intervention, and it being impossible for a document to be absent or misplaced without that being visible.

The invention results from a combination of means described below in the following order:

Sheet 1, FIG. 1: a strip (1) for sticking to the top edges of documents that are to be stored vertically, is characterized by:

crenelations (4) on its top edge;

repetitive markings (7) on its top edge;

an adhesive zone (3) adjacent to its bottom edge; and orifices (2) substantially on its longitudinal axis and repeating along its entire length.

Sheet 2, FIGS. 6, 7 and 8: adhesive tabs (15) of different colors that are intended (FIGS. 7 and 8) to be fixed astride the top edge of the strip (1) of the invention, thereby blocking one or more notches (5) or covering and thus uniting two successive repeated marks (7).

Sheet 3, FIGS. 12 and 13 in which FIG. 12 shows a horizontal scale (23N) in one or two parts, including a sequence of squares (24) in which a sequence of digits and numbers in the range 0 to 99 are printed, and one or more blank strips (30) for writing on disposed one above another, and FIG. 13 shows a horizontal scale (23AN) in one or two parts and having a series of blank squares (24) awaiting user inscriptions, and one or more blank strips (30) for writing on.

Returning now to sheet 1 to examine FIGS. 1 to 5, the first of the means which in combination constitute the invention are described, with FIGS. 1 and 2 showing the strip (1) of the invention that is characterized by:

its top edge whose crenelations (4) give rise to notches (5) and to solid portions (6);

the repetitive marks (7) on its top edge, which marks can be seen (FIG. 2) on its front face (10) on its edge proper (12) and on its rear face (11); said repetitive marks (7) are made either by a printing method, or by damping, or by any other suitable method;

its adhesive zone (3) close to its bottom edge for fixing to the top edge of a document; and its orifices (2) that are repeated along its entire length and that are designed to receive the suspension rods of vertical filing cabinets.

In the preferred embodiment of the strip (1) of the invention, the crenelations (4) are regular, i.e. the notches (5) are all identical and they repeat at the same pitch (e, FIG. 1) with the distances (L1, FIG. 1) between the notches (5) and the longitudinal axis on which the orifices (2) are located being identical from one end of the strip (1) to the other and from one strip (1) to another strip (1).

The position (L, FIG. 1) of the crenelations (4) relative to the vertical axes through the orifices (2) is strictly the same from one end to the other of the strip (1) and from one strip (1) to the other strip (1).

In the preferred embodiment (FIG. 1) the notches (5) in the strip (1) of the invention are semicircular in shape, they are all of identical size, and they repeat at the same pitch.

In other embodiments, the notches (5) may be of any other geometrical shapes, they may be regular or irregular, and they may repeat at different pitches, however they are positioned relative to the orifices (2) such that when a plurality of strips (1) of the invention are juxtaposed one in front of another, then the notches (5) are also juxtaposed one in front of another, each coinciding and superposing exactly with the notch behind it.

FIG. 3 shows a plurality of strips (1) of the invention, juxtaposed one in front of another vertically, the orifices (2) being exactly superposed, the notches (5) being in accurate alignment, and their adjacent positions giving rise to grooves (5*r*), and the continuity of the repetitive marks (7) giving rise to stripes (7*r*).

In this preferred embodiment, the strips (1) of the invention have crenelations (4) and marks (7) that are repetitive.

In a first cheaper embodiment, the strips (1) of the invention have crenelations (4) only, FIG. 4 showing a group of such cheaper embodiment strips (1) where only the grooves (5*r*) that result from the notches (5) being adjacent can be seen.

In a second cheaper embodiment, the strips (1) of the invention include only the repetitive marks (7), FIG. 5 showing a group of strip (1) implemented in this cheaper embodiment, and only the stripes (7*r*) that result from the marks being contiguous can be seen.

In the preferred embodiment, the marks (7) are all identical, and they repeat at a regular pitch; nevertheless, they could be different, and they could repeat at irregular pitches, providing that all of the strips (1) are identical with respect to their marks such that when they are superposed with their orifices (2) coinciding exactly, each mark (7) on each of the strips is superposed with and coincides exactly with an identical mark on the strip (1) behind it.

The two cheaper embodiments of the strip (1) require the user of the invention and of the method to pay a little more attention than is required in the preferred embodiment, but nevertheless they do not harm the looked-for result which is the ability to locate a given document visually and without manual intervention, regardless of where that document may be amongst the others.

The strip (1) of the invention is made of a material that is as thin as possible, but that provides adequate strength given the weight of the documents that it is to support.

This material may be presspahn, polyester, or PVC, this list not being limiting.

When the sheet that has been used or that is to be used as the medium for making the document itself has strength characteristics that are equal to or better than those of a strip (1) of the invention, e.g. polyester or film, then the crenelations (4) and the repetitive marks (7) of the invention, and also with the orifices (2) may be formed directly in the upper portion of the sheet itself.

The sheets and strips (1) of the invention are characterized by the crenelations (4) and the repetitive marks (7) on their top edges, and they may include orifices (2) for receiving the suspension rods of filing cabinets, however they equally well have any other orifices required for receiving other members of filing cabinets, e.g. the racks of separator devices.

We now examine (FIGS. 6, 7, and 8, sheet 2) the second of the means that in combination constitute the invention FIG. 6 shows an adhesive tab (15) made in various colors and intended to be fixed by the user astride the top edge of the strip (1) of the invention, blocking off one or more of notches (5) or uniting by overlying two or more pairs of repetitive marks (7), see FIGS. 7 and 8.

The tab (15) of the invention is characterized by a rib (17) situated perceptibly beneath its axis (xy) and having a height of a few millimeters, the rib being constituted by an add-on piece of thickness substantially equal to the thickness of the strip (1).

The tab (15) is made of a thin material, e.g. cellulose film, and its width is equal to or perceptibly less than the width of a notch (5) plus the widths of the solid portions (6) adjacent thereto, or else the widths of a pair of repetitive marks (7) plus the gap between them.

In their preferred embodiment, the tabs (15) are rectangular, however they could be of any other shape, such as circular, square, or trapezium-shaped, said list not being limiting.

FIG. 7 shows how a tab (15) is installed on a strip (1) by the user of the invention: the tab (15) is positioned so as to bring its rib (17) into contact with the top edge of the strip (1), the lower portion (16) of the tab (15) is stuck to the strip (1), after which the upper portion (16*a*) is folded down.

FIG. 8 shows a tab in its in-use position, the tab (15) being visible via its face (22) and via the bulge (21) that results from the presence of the rib (17).

Figure 1:
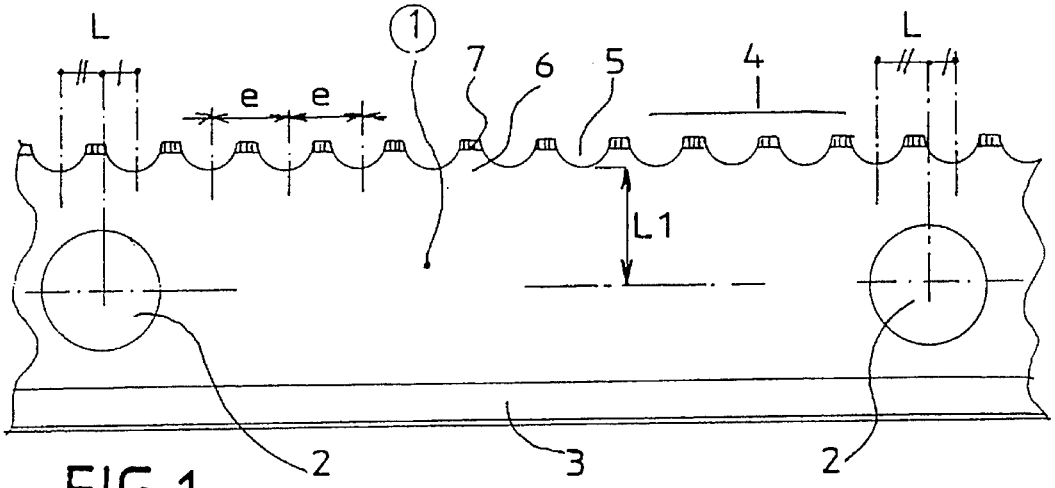
Figure 2:
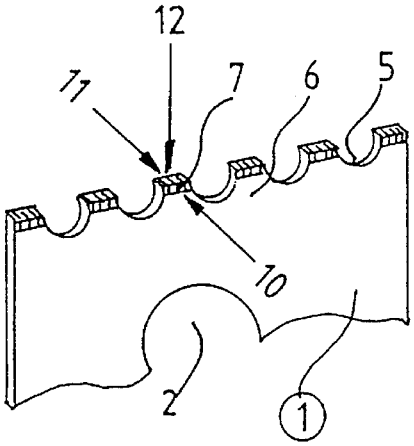
Figure 3:
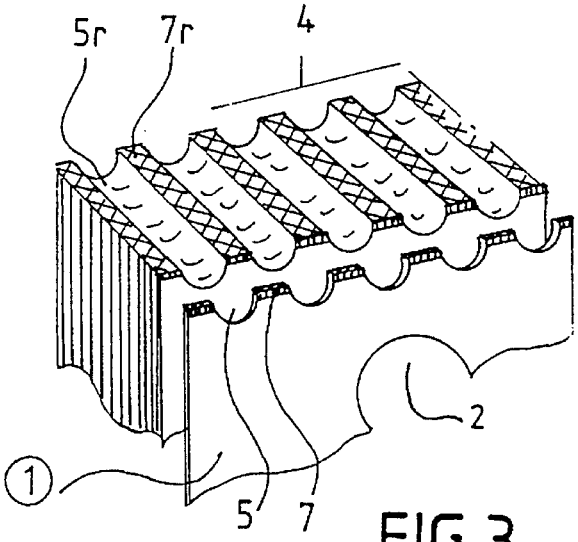
Figure 4:
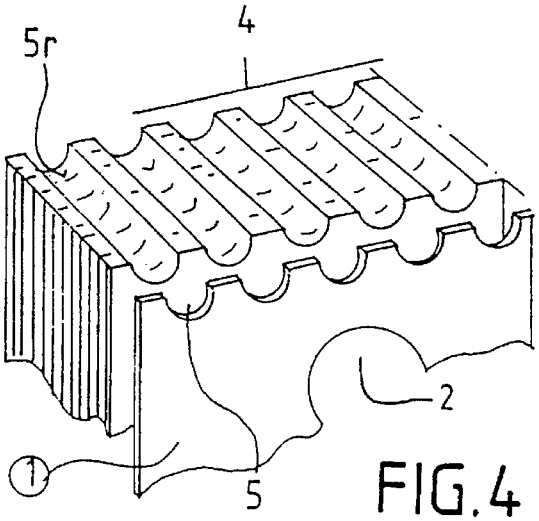
Figure 5:
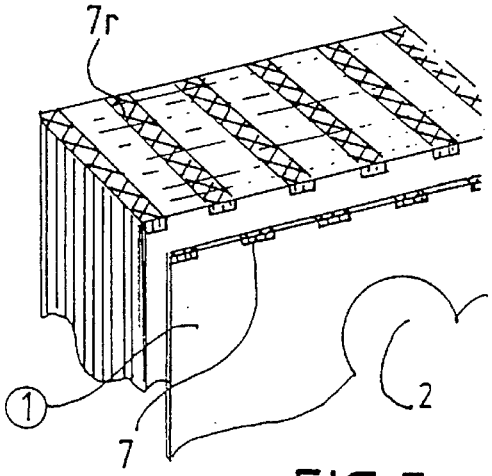

FIG. 9 shows a tab (15) in position on one of the strips (1) in a group of preferred embodiment strips (1 g) i.e. strips including on their top edges both crenelations (4) and repetitive marks (7). It can be seen that the tab (15) is highly visible in the groove (5*r*) that results from juxtaposing the notches (5), which groove is clearly delimited by the stripes (7*r*) that result from juxtaposing the repetitive marks (7).

For strips (1) constituting the first cheaper embodiment of the invention, i.e. that have crenelations (4) only on their top edges, the grooves (5*r*) are not delimited by stripes (7*r*), thus requiring a little more attention on the part of the user when looking for the tabs (15) on the strips (1) supporting the desired documents.

FIG. 10 shows a tab (15) in position on one of the strips (1) in a group of the second cheaper embodiment of strips (1 g) of the invention, i.e. strips that have repetitive marks (7) only on their top edges. The tab (15) can be seen by the user only because of its bulge (21) that stands proud from the mass of other strips (1). In this case also, the user needs to pay a little more attention when looking for the tab (15), but the end result is not compromised.

FIG. 11 is a plan view showing a group (1 g) of strips (1) of the invention, each comprising strips in two series: series "a" to "b" and series "c" to "d" are fitted with respective tabs (15), and it can be seen that it is easy for the user to locate where each of these series is to be found, and to observe, by way of example, that in the series "c/d", one of the strips is missing.

Figure 12:
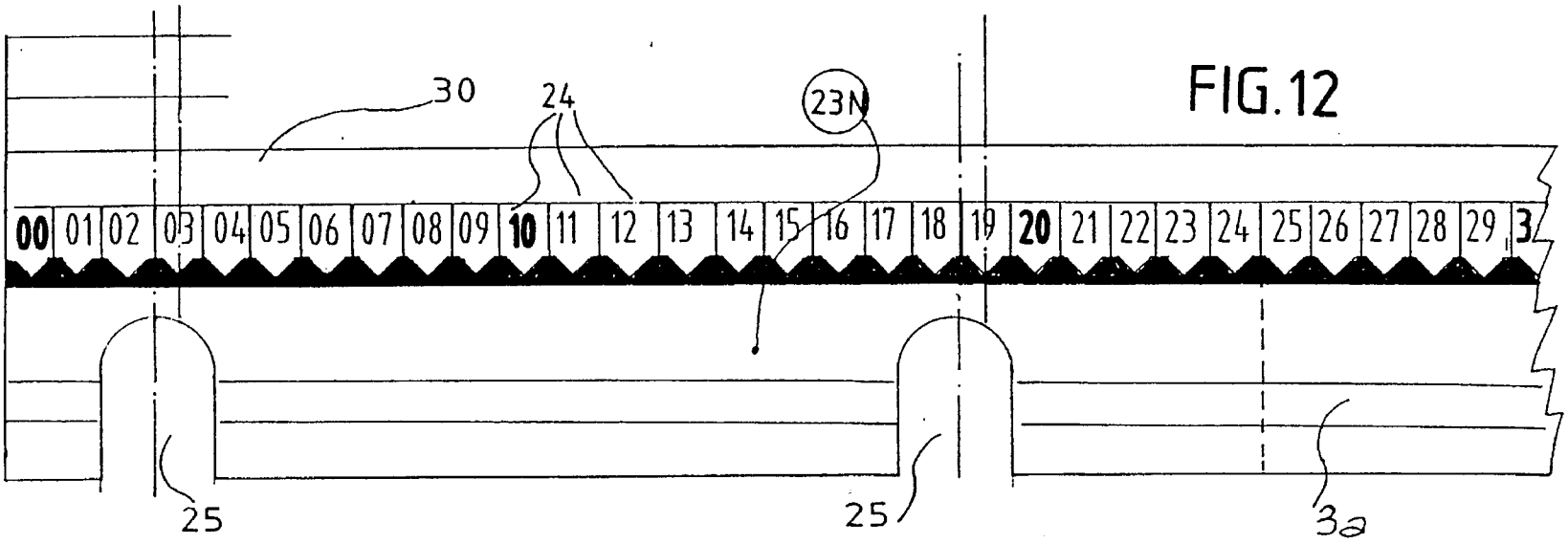
Figure 13:
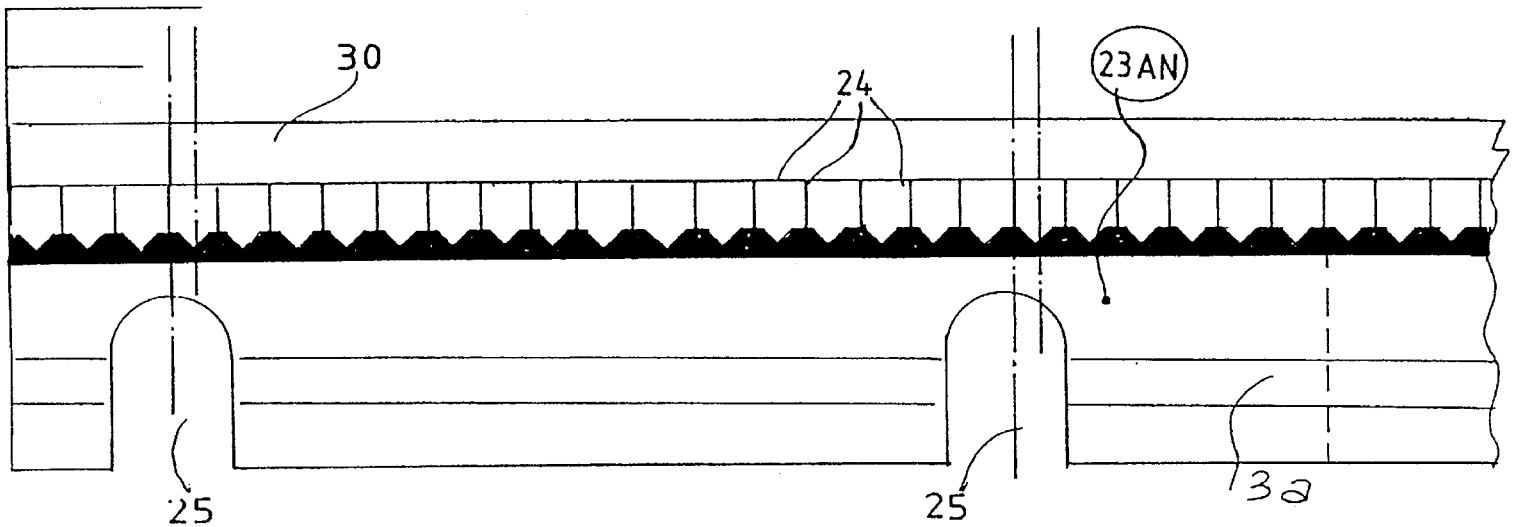

The third of the means that in combination constitute the invention is now examined with reference to sheet 3, FIGS. 12 and 13.

FIG. 12 shows a horizontal scale (23N) of the invention for use in the method of vertically storing documents that are identified by means of a digit or a number. FIG. 13 shows the scale (23AN) of the invention for use in the method of vertically storing documents in which the identity of a document is expressed by digits and by alphabetical characters.

In the invention, both of the scales (23N) and (2SAN) are made of two different materials. Those scales (23N) and (23AN) that are designed to be placed behind the documents so as to avoid cluttering the field of view of the user, are made of opaque material, e.g. card or rigid plastic. However those scales (23N) and (23AN) that are designed to be positioned amongst the documents are made of rigid transparent material such as thin plexiglass, for example, so as to obstruct the field of view of the user as little as possible.

The scales (23N) and (23AN) of the invention are characterized by:

a series of squares (24) extending along their entire length;

blank strips (30) for writing on situated above the squares (24), and comprising 1, 2, 3 or even more such strips; and repetitive slots (25) formed in their bottom edges and designed to locate them on the suspension rods of the vertical filing cabinets, which slots are repeated at the same pitch as the pitch of said rods.

The squares (24) on the scales (23N) carry a series of digits with printed numbers going from 0 to 99, while the squares (24) on the scale (23AN) are blank, ready to receive handwriting or any other form of marking provided by the user.

Clearly, the item called a "scale" (23AN) in the present patent does not genuinely become a "scale" until after the user has marked it.

The scales (23N) and (23AN) of the invention may be constituted by single pieces when the documents are all wide, or they may be constituted by two pieces.

By way of example:

When storing industrial drawings of dimensions standardized by the French standards authority (AFNOR), the basic format "AO" occupies 1 $m^2$, having a width of 840 mm, the scale is divided into two equal portions, that come to perceptibly less than 840 mm, e.g. 800 mm (400 mm×2).

The two 400 mm half-scales are located in the filing cabinet with a gap of 20 mm between them, thereby occupying a total width of 820 mm, and thus cover the 40 mm of an "AO" sized sheet with a gap of 10 mm on either side. Submultiples of the "AO" format, e.g. those having a width of 420 mm, can similarly be used with each of said half-scales likewise leaving gaps of 10 mm on either side.

In special cases, the scales (23N) and (23AN) can be subdivided into as many smaller pieces as may be necessary.

Since the scales (23N) and (23AN) of the invention are designed to be used in combination with the crenelated suspension strip (1) of the invention, a certain number of similarities and constant dimensional ratios are to be found between them.

Figure 14:
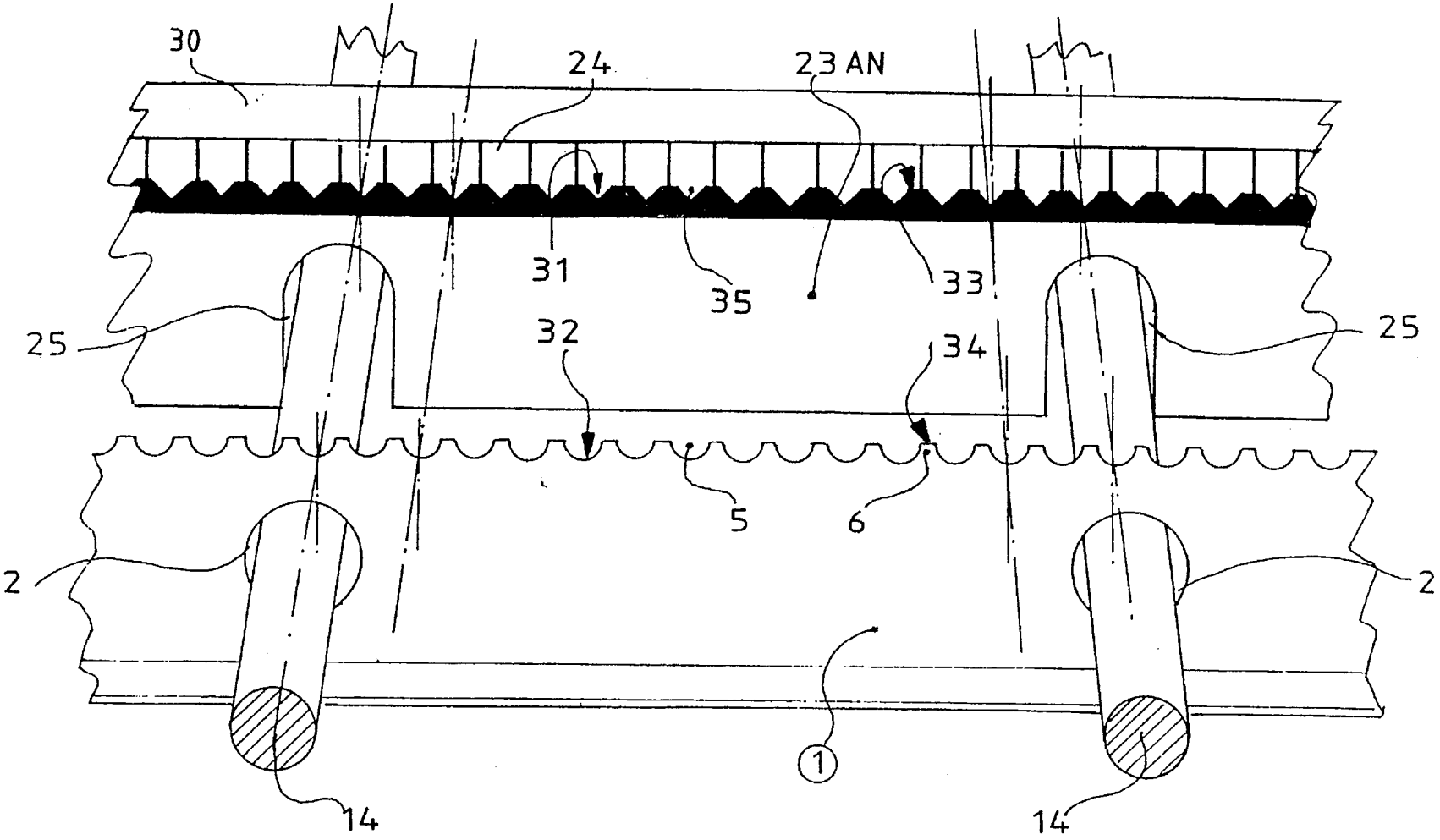

FIG. 14, sheet 4, shows a scale (23AN) and a crenelated suspension strip (1) of the invention both suspended from the same suspension rods (14), the slots (25) of the scale (23AN) and the orifices (2) of the strip (1) having the same spacing, and the distribution of the squares (24) on the scale (23AN), and likewise on the scale (23N), relative to the axes of the slots (25), and the distribution of the notches (5) in the strip (1) relative to the axes of the orifices (2) being identical such that each square (24) is thus accurately in alignment with one of the notches (5).

In the preferred embodiment shown in FIG. 14, the squares (24) are genuinely square, but they could be rectangular, and they are extended downwards by a triangular portion (35) representing an arrow. The notches (5) of the strip (1) of the preferred embodiment are semicircular. The bottom tips (31) of the triangular portions (35) of the squares (24) are level with the lowest points (32) of the notches (5) of the strip (1). The base (33) of the square or rectangular portion of each square (24) are level with the tops (34) of the solid portions (6) of the crenelations on the strip (1) see FIG. 15, sheet 5.

Figure 15:
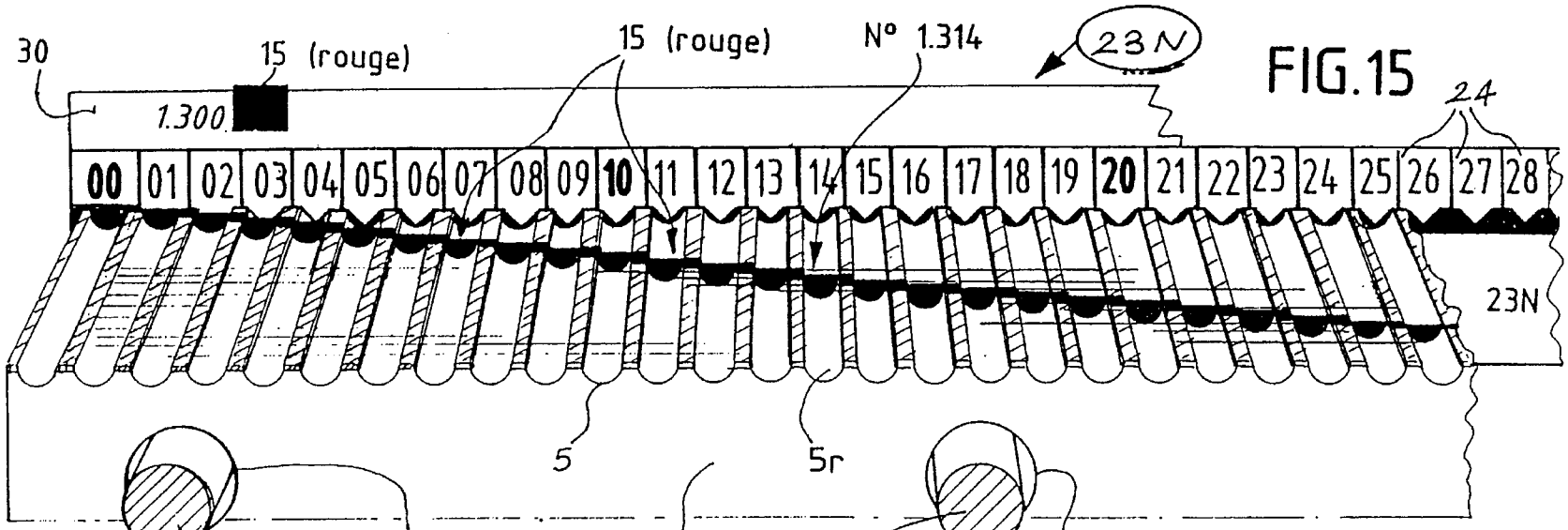

FIG. 15, sheet 5 shows the three means which in combination constitute the invention in use, namely a scale (23N), strips (1) from which the documents are suspended, and tabs (15).

An example of use:

The documents that are to be stored in the filing cabinet or on rods fixed to any kind of support, are numbered in a given order, with the first document bearing the number "1300".

For the first 100 documents (Nos. 1300 to 1399) the user has chosen tabs (15) that are red in color, and by way of reminder, a red tab (15) is stuck to the writing strip (30) of the scale (23N) and the number "1300" is written thereon.

Thereafter, each time a document is stored in the filing cabinet for the first time, a red tab (15) is used to block that one of the notches (15) in the document-supporting strip (1) that lies in the groove (5*r*) leading to the square (24) on the scale (23N) in which the tens and the units digits terminating the number of the document are to be found, in this example, for document No. 1314, the square containing "14".

In FIG. 15, it can be seen that each of the documents is present and can be located visually without manual intervention.

Figure 16:
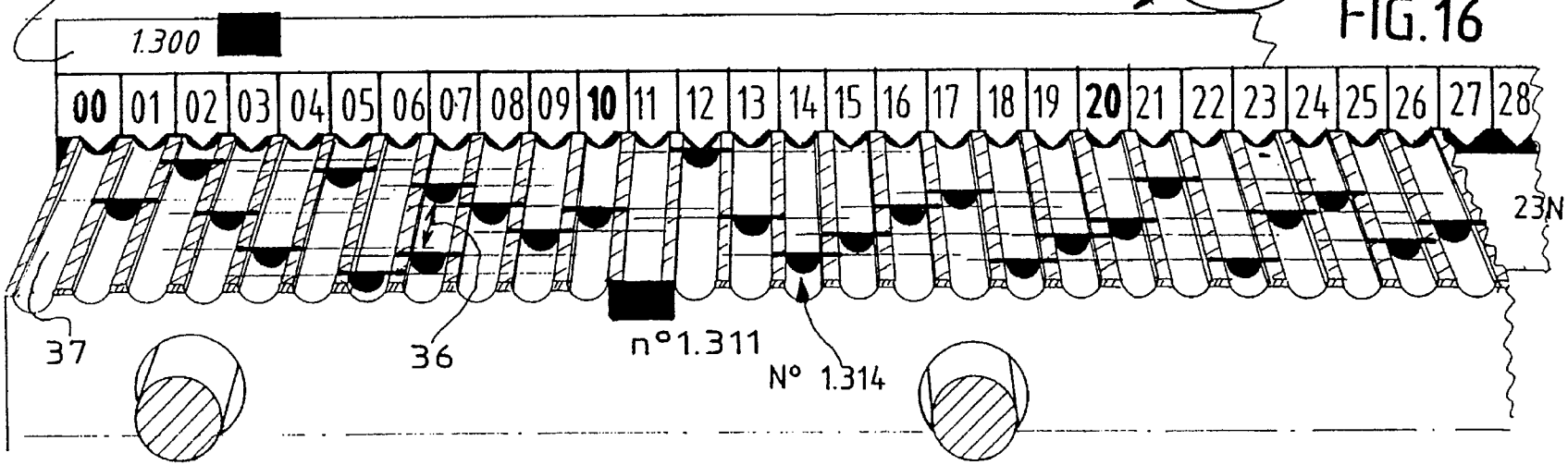

FIG. 16 shows the same system as FIG. 15, but after the documents, each individualized by means of its own tab (15), have been shuffled into an arbitrary order. It can be seen that each of the documents remains just as easy to locate (for example the document No. 1314), it is also just as easy to see that in the groove associated with square "07" of the scale, there is a sheet (36) that is in the wrong place, and that doubtless belongs to another filing cabinet, and also that there is no document No. 1300 (37).

Figure 17:
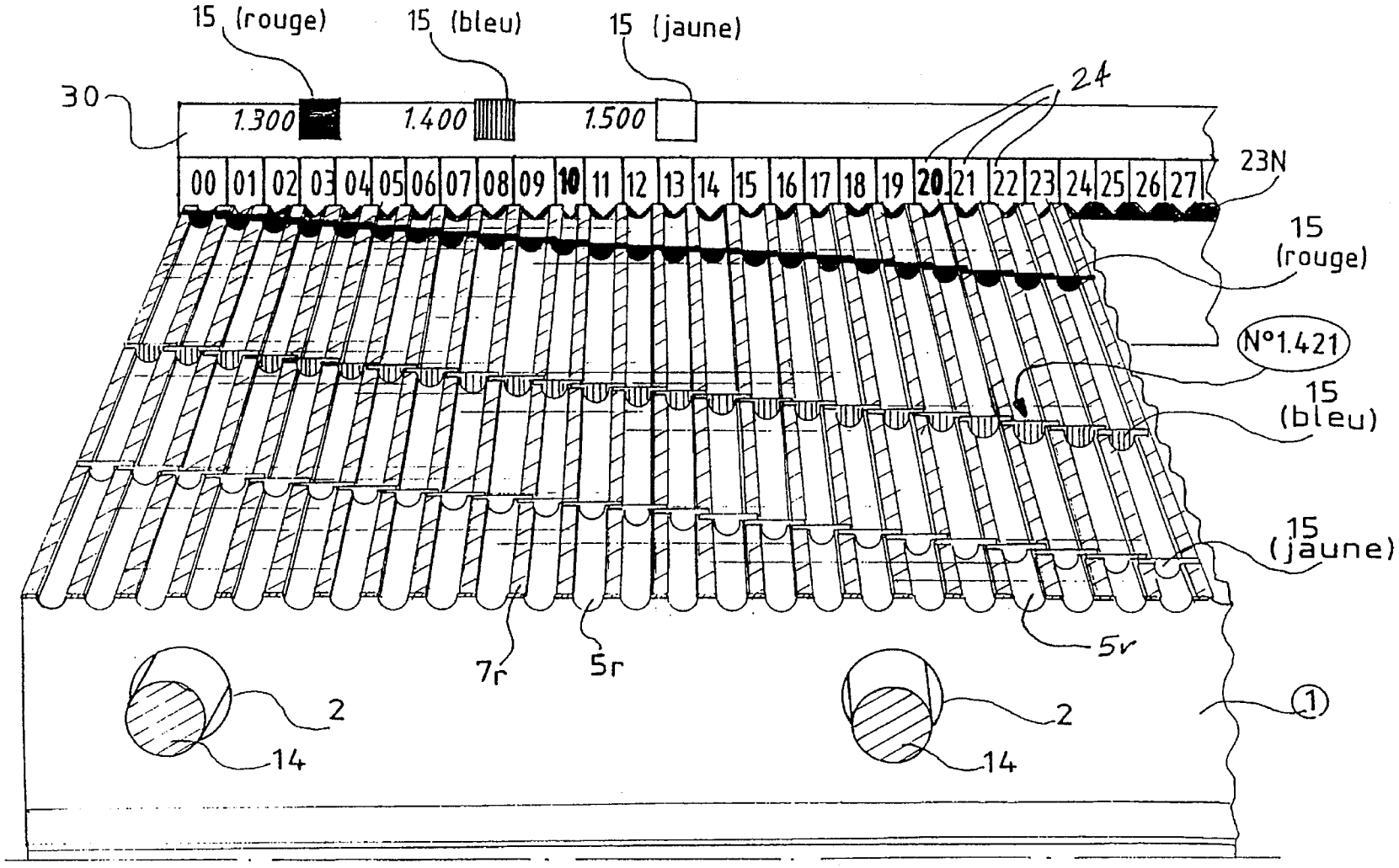

FIG. 17, sheet 6, follows on from FIG. 16 of sheet 5: after individualizing each of the documents in the hundred 1300 to 1399, the user has performed the same operations for the documents in the next hundred 1400 to 1499, and then the next 1500 to 1599. In the hundred 1400 to 1499, the user has used blue tabs (15) and in the hundred 1500 to 1599, the user has used yellow tabs (15).

To locate one of the documents, e.g. the document whose number is 1421, the user consults the strip (30) of reminder tabs (15) which indicate that the tab personalizing this particular document is blue. Thereafter the user finds the blue tab of document No. 1421 in the groove (5*r*) that leads to the square (24) numbered 21 (1421).

Figure 18:
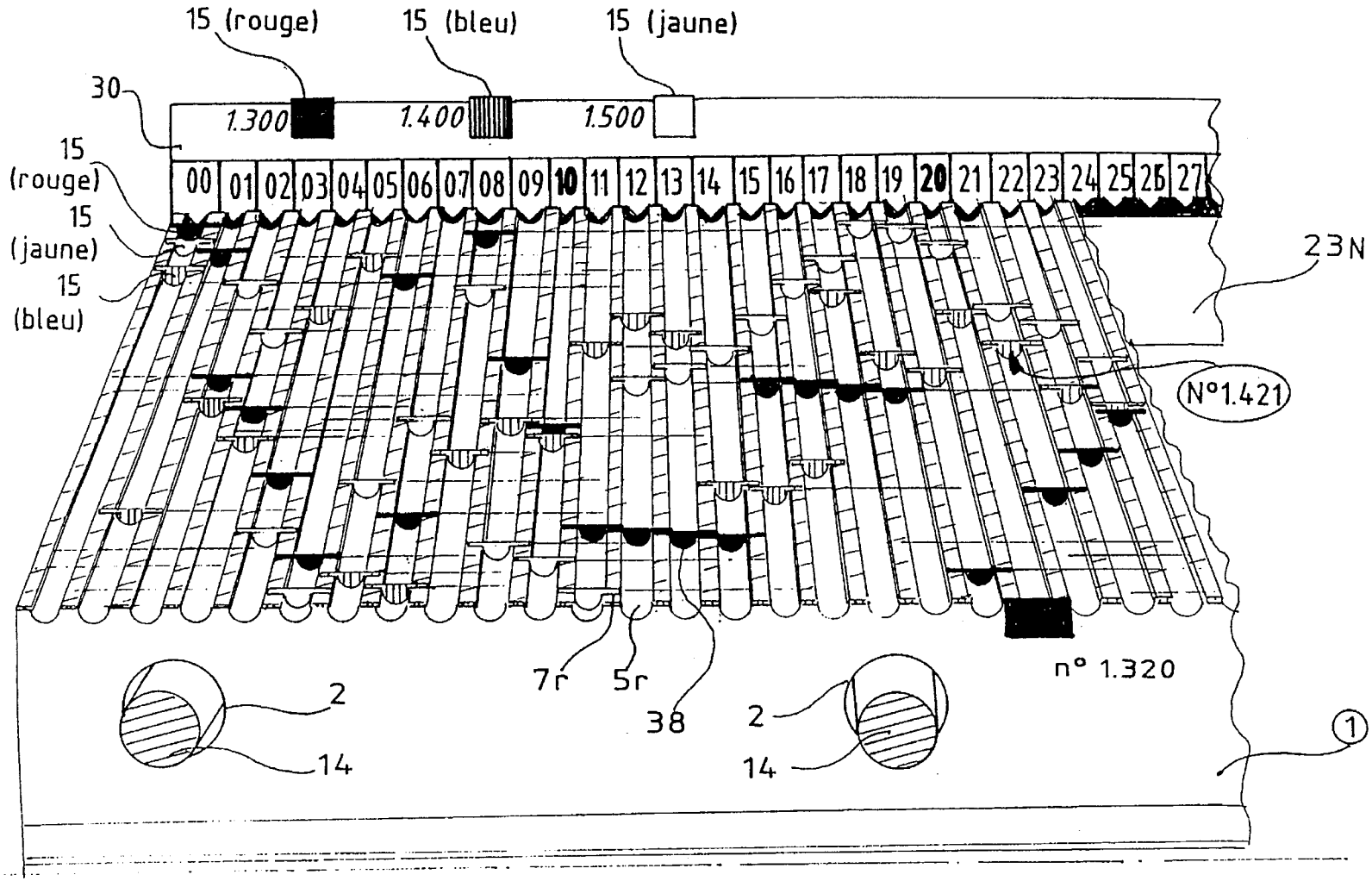

FIG. 18, sheet 7 follows on from FIG. 17 of sheet 6 and by now all of the documents have been removed for consultation purposes and then returned to the filing cabinet, one in front of another without paying attention to their order. It can be seen that sheet No. 1421, for example, is still just as easy to find, and providing all of the sheets making up a single dossier such as the group referenced (38) are always put back into place together, then they stay together.

The facility enabling the user to replace documents or groups of decuments one after another without paying attention to their numerical order constitutes a significant advantage, greatly reducing the time required for manipulation, particularly when the documents occupy several square meters.

Figure 19:
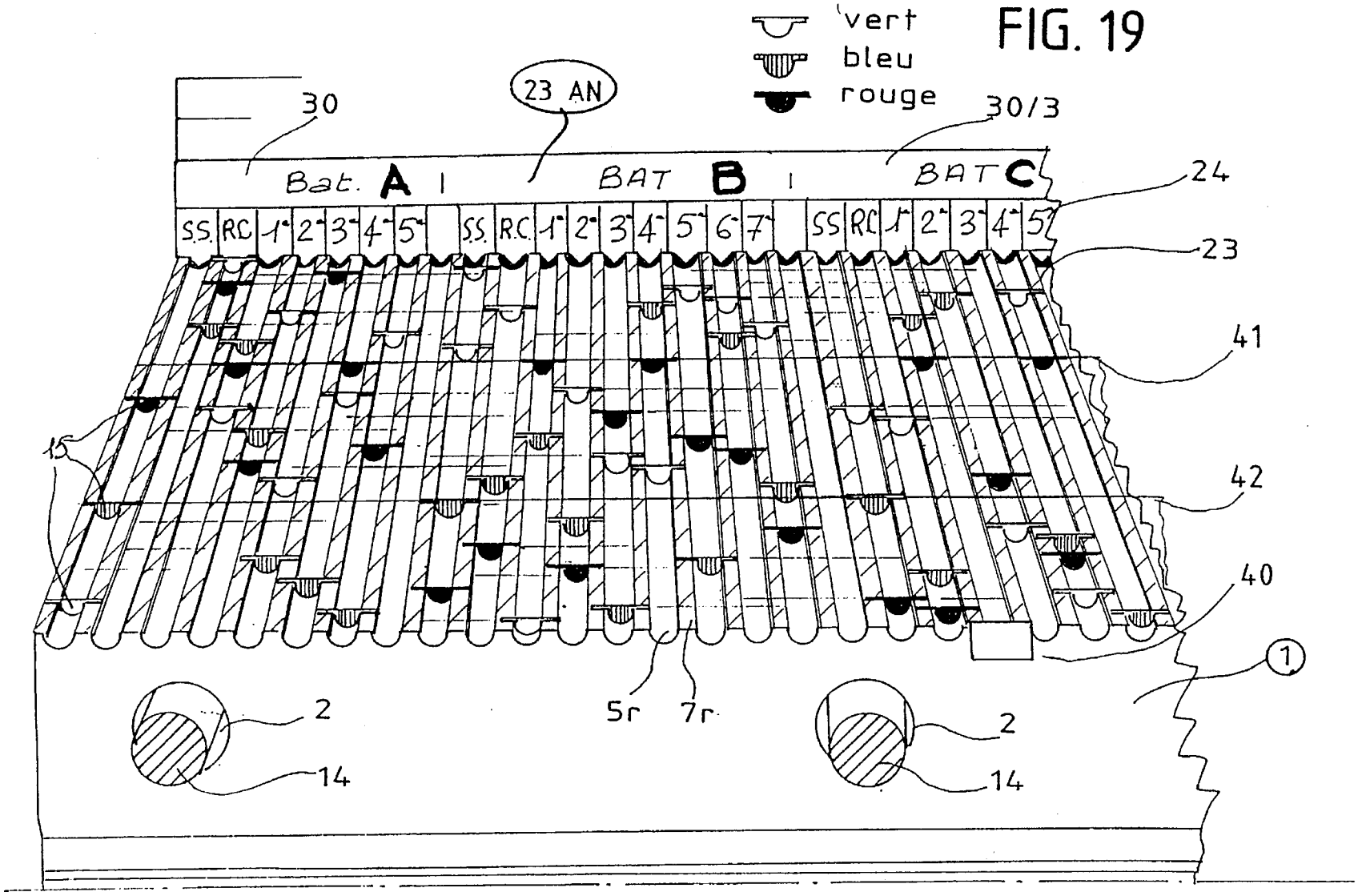

FIG. 19, sheet 18 shows the invention in use for alphanumeric classification of sheets by headings and subheadings, a scale (23AN) being used.

The selected example is simple. The idea is to provide vertical storage for plans for water, gas, and electricity circuits, for each of the floors of each building in a set of buildings (building A, building B, building C). The abbreviations chosen by the user as titles for these headings are:

SS for basement, RC for ground floor, 1 for first floor, etc . . . . and the colors chosen by the user for symbolizing these headings are: blue tabs (15) for water, green for gas, red for electricity.

The names of the buildings (A, B, C) are written on the strip for writing (30) while the abbreviations for the headings (SS, RC, 1, etc . . . . ) are written in the squares (24) of the scale (23AN).

An example of use (40): the last-stored plan in the filing cabinet of FIG. 19 is for the "GAS" circuits of the first floor of building C—the user has thus personalized this plan with a green tab (15) that blocks the notch (5) of the supporting strip (1) that forms a portion of the groove (5*r*) corresponding to the first floor of building C. Thus, wherever the plan may be located within the filing cabinet, it is easily located.

Example of use (41): the installations of the "ELECTRICITY" circuits in the first and fourth floors of buildings A, B, and C are identical: only one plan (41) has therefore been drawn up, and it is fitted with six red tabs (15). The user can thus find this plan using six different lines of attack: building A first floor, building A fourth floor, building B first floor, building B fourth floor, building C first floor, and building C fourth floor.

Example of use (42): the installations of the "WATER" circuits in the basements of buildings A, B, and C are identical, so only one plan (42) has been drawn up, and it is fitted with three blue tabs (15).

The above examples give an idea of the numerous ways in which the invention and the method can be used, additional strips (30) for writing on further make it possible to extend, without limit, the number of titles, subtitles, headings, subheadings, etc.

When the invention and the method of the invention are used for classifying offset films for printing, then the tabs (15) used have the same color as the printing color specific to each film, for example: with four-color printing, the tabs (15) used are in the four primary colors: black, blue, red, yellow.

We claim:

1. A system for filing and identifying documents, the system comprising:

a suspension strip (1) with a lower edge fixed to an edge of a corresponding document, the suspension strip having an orifice through which a suspension rod (14) of a filing cabinet extends, a top edge of said strip having a series of notches (5), separated by portions of the top edge between said notches (5), wherein the series of notches (5) of adjacent suspension strips give rise to a series of substantially parallel grooves (5*r*) perpendicular to said suspension strips (1) and to said documents;

a scale (23N) having a plurality of indicators (24), said scale is positioned behind said documents, wherein each of said indicators is aligned with a corresponding groove (5*r*); and p1 a tab (15) fixed to the top edge of each suspension strip (1) over one of its notches and constituting a guide mark for each document corresponding to an indicator (24) on said scale (23N).

2. A system according to claim 1, characterized in that said indicators (24) are substantially rectangular in shape and are extended downwards by respective triangular portions (35) symbolizing arrows.

3. A system according to claim 1, in which said suspension strips extend over a length of said documents and each suspension strip includes an adhesive zone on its lower edge for adhering to a top edge of the document.

4. A system according to claim 1, characterized in that said tabs (15) are adhesive and of different colors, said tabs are positioned to block said notches (5) by adhering to a portion of said strip on either side of the blocked notch.

5. A system according to claim 1, characterized in that each of said tabs (15) includes a rib (17) about which it can be folded so as to be fixed astride a portion of the top edge of said suspension strip (1), said tabs including adhesive faces that are folded against and adhered to said strip.

6. A system according to claim 1, characterized in that said scale comprises a semi-rigid strip (23N/23AN) that includes, in addition to said indicators (24), at least one blank zone (30) on which additional information may be displayed.

7. A system according to claim 6, characterized in that said scale is of substantially the same length as the suspension strip (1) and includes a slot (25) for engaging the suspension rod (14).

8. A system according to claim 1, characterized in that the positions of the slot (25) relative to a top edge of said scale (23N/23AN) and the position of the orifice (2) relative to the top edges of the suspension strips (1) are determined in such a manner that when a group of strips (1) and a scale (23N/23AN) rest on said suspension rods (14), then the indicators (24) of said scale are situated above said notches (5).

9. A system according to claim 1, characterized in that it includes at least two scales (23N/23AN), wherein a front scale (23N) is made of transparent material and a rear scale (23AN) placed behind said front scale (23N) is made of opaque material.

10. A system according to claim 1, characterized in that said scale (23N/23AN) include tabs on a top portion (30) for displaying identification information.

11. A system for filing and identifying documents in a filing cabinet, said system comprising:

a suspension strip fixed to a top edge of each document, said suspension strip including an orifice for receiving a suspension rod of the filing cabinet, said suspension strip including a series of notches with an edge interposed between said notches, said series of notches being identical from one suspension strip to one another;

a scale positioned behind said suspension strips of said documents, said scale having a first part of identification information displayed thereon, said first part of said identification information on said scale being aligned with grooves formed by alignment of said series of notches of adjacent suspension strips; and a tab fixed to a top portion of each suspension strip, said tab constituting a guide mark for said document corresponding to the suspension strip to which said tab is fixed, wherein said tabs display a second part of said identification information which is displayed on a top portion of said scale.

12. A system according to claim 11, characterized in that said tabs are adhesive, said tabs positioned to block said notches by adhering to an edge portion of said strip on either side of the blocked notch.

13. A system according to claim 11, characterized in that each of said tabs includes a rib about which it can be folded so as to be fixed astride a portion of a top edge of said suspension strip, said tabs including adhesive faces that are folded against and adhered to said suspension strip.

14. A system according to claim 11, characterized in that said scale comprises a semi-rigid strip that includes at least one blank zone on which said second part of said identification information is displayed.

15. A system according to claim 11, characterized in that said scale is of substantially a same length as said suspension strips and includes a slot for engaging the suspension rod.

16. A system according to claim 11, characterized in that positions of the slot relative to a top edge of said scale and a position of the orifice relative to top edges of the suspension strips are determined so that when a group of strips and a scale rest on said suspension rods, the indicators are situated above said notches.

17. A system according to claim 11, comprising at least two scales wherein a front scale is made of transparent material, and a rear scale, placed behind said front scale, is made of opaque material.

18. A system for filing and identifying documents in a filing cabinet, said system comprising:

a suspension strip fixed to a top edge of each of said documents, said suspension strip including an orifice for receiving a suspension rod of the filing cabinet, said suspension strip including a series of marks, said series of marks being identical from one suspension strip to one another;

a scale positioned behind said suspension strip of said documents, said scale comprising a plurality of information areas having a first part of an identification means displayed thereon, said information areas being aligned with a corresponding row of marks formed by alignment of said series of marks of adjacent suspension strips; and a tab fixed to a top edge of each suspension strip, said tab constituting a guide mark of a drawing suspended to said suspension strip to which said tab is fixed, wherein said tabs display a second part of said identification means which is also displayed on a top portion of said scale.

19. A system according to claim 18, characterized in that said scale is of substantially a same length as said suspension strips and includes a slot for engaging the suspension rod.

20. A system according to claim 18, characterized in that each of said tabs includes a rib about which it can be folded so as to be fixed astride a portion of a top edge of said suspension strip, said tabs including adhesive faces that are folded against and adhered to said suspension strip.

* * * * *